United States Patent [19]

Crissman et al.

[11] Patent Number: 4,972,783

[45] Date of Patent: Nov. 27, 1990

[54] ADJUSTABLE SHELVING

[75] Inventors: Stanley R. Crissman, West Dundee, Ill.; David Kazimier, Genoa City, Wis.

[73] Assignee: Crissman Manufacturing Company, Huntley, McHenry County, Ill.

[21] Appl. No.: 413,433

[22] Filed: Sep. 27, 1989

[51] Int. Cl.[5] ..... A47B 9/00

[52] U.S. Cl. ..... 108/107; 108/146; 211/192

[58] Field of Search ..... 108/107, 110, 144, 146, 108/111; 211/208, 187, 190, 191, 192

[56] References Cited

U.S. PATENT DOCUMENTS

| | | | |
|---|---|---|---|
| 3,273,720 | 9/1966 | Seiz | 108/107 X |
| 3,388,809 | 6/1968 | Frush | 211/191 X |
| 3,612,290 | 10/1971 | Evans | 211/187 X |
| 4,292,902 | 10/1981 | Barrineau | 108/110 X |
| 4,379,430 | 4/1983 | Ruschitzka | 108/110 X |
| 4,603,782 | 8/1986 | Fenwick | 108/107 X |

FOREIGN PATENT DOCUMENTS

| | | | |
|---|---|---|---|
| 615210 | 2/1961 | Canada | 108/107 |
| 2808855 | 9/1979 | Fed. Rep. of Germany | 108/107 |

*Primary Examiner*—Jose V. Chen

*Attorney, Agent, or Firm*—Mathew R. P. Perrone, Jr.

[57] ABSTRACT

An adjustable shelf assembly, especially for storing food containers, includes at least two vertical stanchions having apertures in each U-shaped side thereof to receive at least two horizontal bars with at least one spring loaded shot pin in each end thereof to fit into an aperture in the stanchions and lock thereon with a J-shaped lip.

17 Claims, 4 Drawing Sheets

FIG. 2
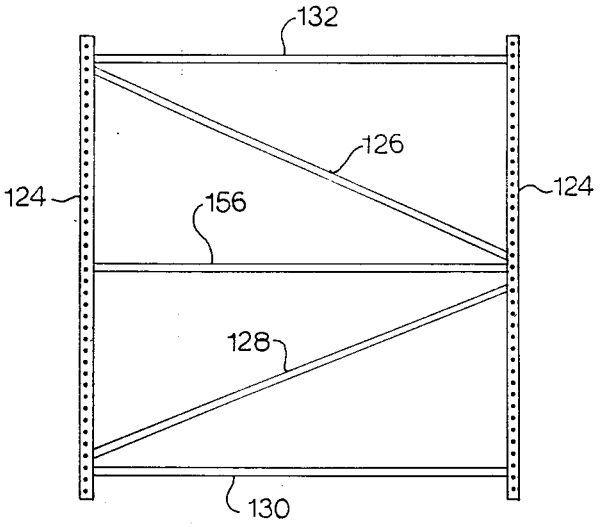
FIG. 3
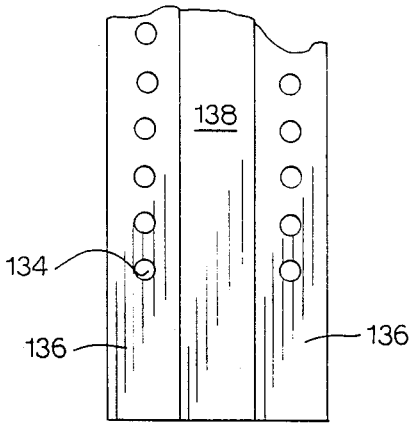
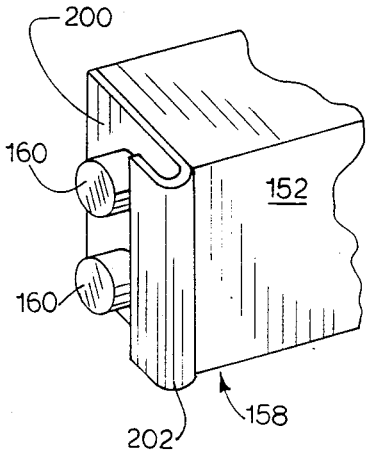
FIG. 4
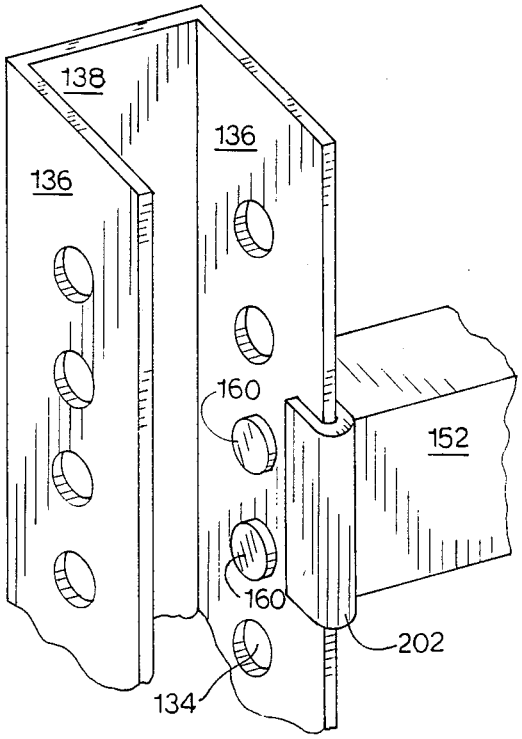
FIG. 5
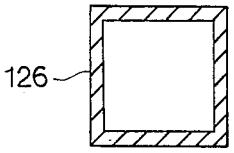
FIG. 13

FIG. 9
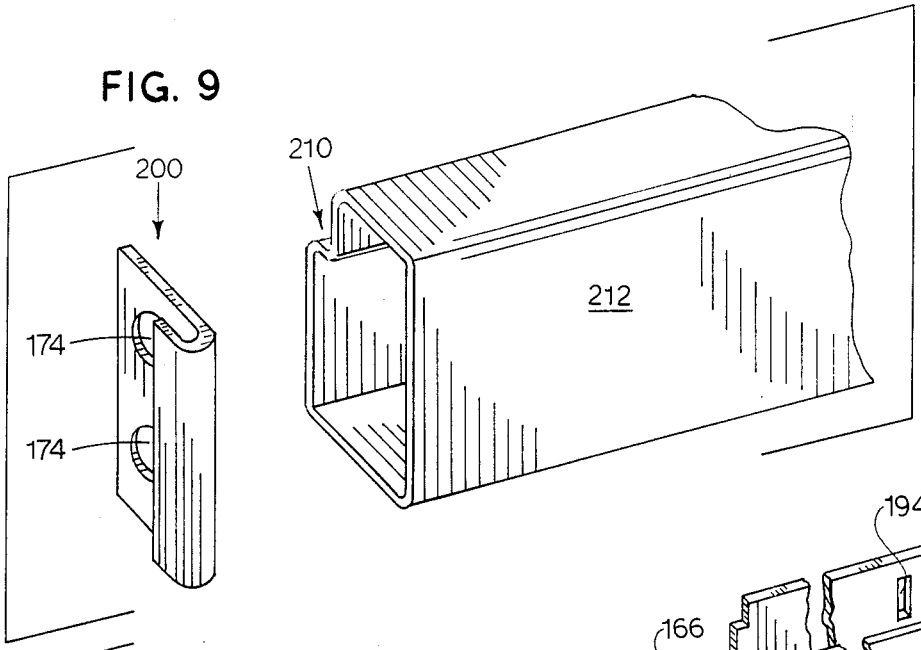
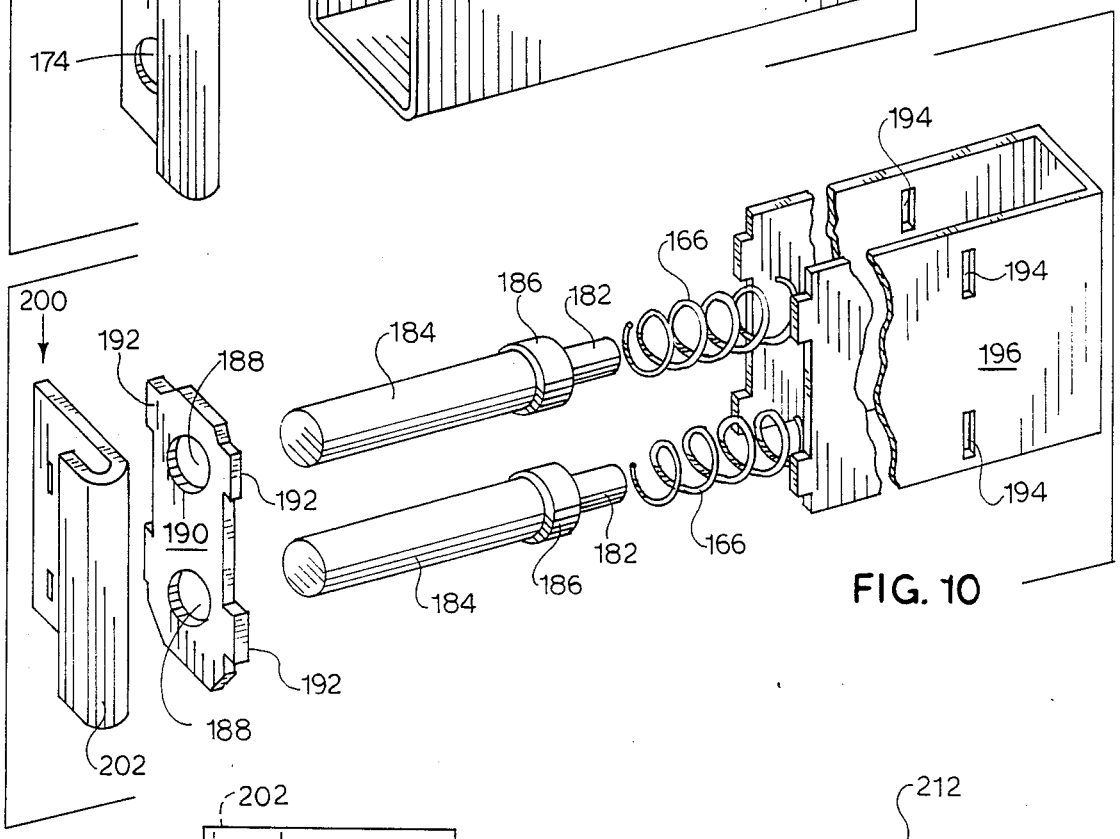
FIG. 10
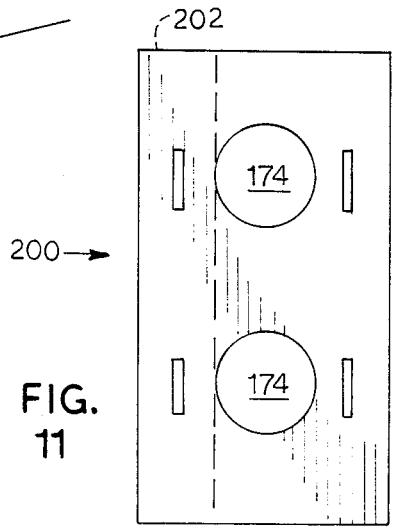
FIG. 11
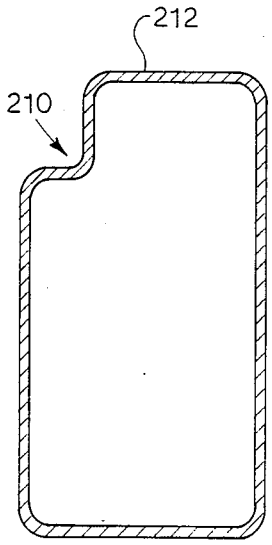
FIG. 12

ADJUSTABLE SHELVING

BACKGROUND OF THE INVENTION

This invention relates to an adjustable shelf device and more particularly to a heavy-duty, wide-span, adjustable shelf device especially suitable for use in the food service industry which substantially minimizes contamination of the shelf adjusting mechanism with food.

An adjustable shelf assembly is very useful. Since shelves are constantly used for storage, adjustability provides for a wide variety of materials of various sizes to be stored at differing times. Such flexibility is extremely useful in any industry. This flexibility of shelf adjustment provides for various sizes of material being stored on the shelves as desired. Variations due to adjustability of shelving achieves these desired results.

Especially in the food industry, adjustability of shelving is desired. It is rarely accurately known whether large or small objects or food containers will need to be stored on a shelf assembly. If these large or small objects can be stored efficiently on shelves adjusted as required, more efficient use of food storage areas can be achieved. Such action is especially valuable in the refrigerated areas. It is very costly to have a refrigerated area improperly used. If the shelves cannot be adjusted for the size of items being refrigerated, proper use of the refrigerated area cannot be accomplished.

Another major problem especially in a food industry is involved with the necessary structure of an adjustable shelf. The adjustable features of the shelf may necessarily provide crevices. Into these crevices, food residue may fall. With the food residue in the crevices, or even caked within the adjustable mechanism of the shelf, great disadvantages occur. It is completely and totally undesirable to have food residue caked in an inaccessible place. Such food eventually spoils—thereby contaminating and rendering the area in general, and the storage device in particular, unsuitable for food storage.

Still another problem with adjustable shelf devices in the food industry is the fact that some of the food cartons stored are extremely heavy—sometimes weighing around 1,000 kilograms. Accordingly, a shelf must be able to hold the weight without deforming the shelf device. If adjustability is also required, another major problem becomes evident. Strength must usually be sacrificed to achieve adjustability. Adjustability weakens the weight holding capability of a shelf. It is extremely desirable to have both strength and weight holding ability together with adjustability—in spite of the inherently countervailing problems therewith.

The National Sanitary Foundation requires any crevices in food storage apparatus to have crevices less than 0.03125 inch (0.079375 centimeter). This requirement mitigates against providing a food storage shelf—both strong enough to support a great weight of food and tight-fitting enough to meet the requirements of the National Sanitary Foundation.

If this unacceptable food collection occurs in a public facility, the facility can be closed and subject to health department sanctions—as well as other business and legal problems. In a home, such a problem can lead to a food-caused illness. It is, therefore, highly desirable to provide an adjustable shelving mechanism which avoids these problems.

SUMMARY OF THE INVENTION

Therefore, among the many objectives of this invention is the objective to provide a heavy-duty, wide-span, adjustable shelf device.

A further objective of this invention is to provide an adjustable shelf assembly suitable for use in storing food.

A still further objective of the invention is to provide an adjustable shelf assembly without crevices to collect food.

Yet a further objective of the invention is to provide an adjustable shelf assembly which avoids health department problems.

Also an objective of this invention is to provide an adjustable shelf assembly which minimizes food induced illness.

Another objective of this invention is to provide an adjustable shelf assembly which simplifies refrigerated storage.

Yet another objective of this invention is to provide an adjustable shelf assembly which meets National Sanitary Foundation requirements, and avoids crevices which may capture and hold food residue.

Still another objective of this invention is to provide an adjustable shelf assembly which is extremely strong.

These and other objectives of the invention (which other objectives become clear by consideration of the specification, claims and drawings as whole) are met by providing a shelf assembly—especially for food—with vertical stanchions having apertures in each U-shaped side thereof to receive at least one spring loaded shot pin to fit into an aperture in the stanchions and lock thereon with a J-shaped lip.

BRIEF DESCRIPTION OF THE DRAWINGS

FIG. 2 depicts an end view of the adjustable shelf device 100 in order to show the structure of stanchion assembly 120 of this invention.

FIG. 3 depicts a flattened view of the stanchion U-shaped members 124 of this invention.

FIG. 4 depicts a perspective, partial view of bar end 158 of the horizontal support beam 152 of this invention.

FIG. 5 depicts a perspective, partial view of bar end 158 of the horizontal support beam 152 assembled with a stanchion U-shaped member 124 of this invention.

FIG. 9 depicts a perspective, partial exploded view of bar end 158 of the first horizontal support beam 152 of this invention.

FIG. 10 depicts an exploded view of spring loaded assembly 160 with shot pin 180 of this invention.

FIG. 11 depicts a rear side view of J-shaped member cap 200.

FIG. 12 depicts an end view of tubular member 212.

FIG. 13 depicts a cross sectional view of upper tubular cross brace 126.

Throughout the Figures of drawing where the same part appears in more than one Figure of the drawing, the same numeral is applied thereto.

DESCRIPTION OF THE PREFERRED EMBODIMENTS

A heavy-duty, wide-span, adjustable shelf device is formed with at least two stanchion assemblies. The stanchion assemblies have a generally U-shaped member on each side thereof with the base of one U-shaped member facing the base base of the other U-shaped member, and have corresponding apertures in both sides of the U-shaped member. These apertures receive the spring loaded assembly of the horizontal support beams. In this fashion, the apertures permit adjustment of the horizontal support beams and thereby permit adjustment of the heavy-duty, wide-span, adjustable shelf device. Thus, great flexibility is achieved.

The horizontal support beams are basically secured between the apertures and the spring loaded assembly in order to avoid food collection within the tab assembly. By avoiding this feature, the shelves become especially useful in the food industry. A J-shaped lip is on the horizontal support assembly to cooperate with the spring loaded assembly and provide for support of the horizontal beam with respect to the stanchion assembly. The J-shaped lip also holds the stanchion assemblies together, while shot pins in the springloaded assembly position the horizontal support beams. Thus, a substantially sturdy shelf device capable of holding heavy loads of 1,000 kilograms or more is achieved.

Figure 1:
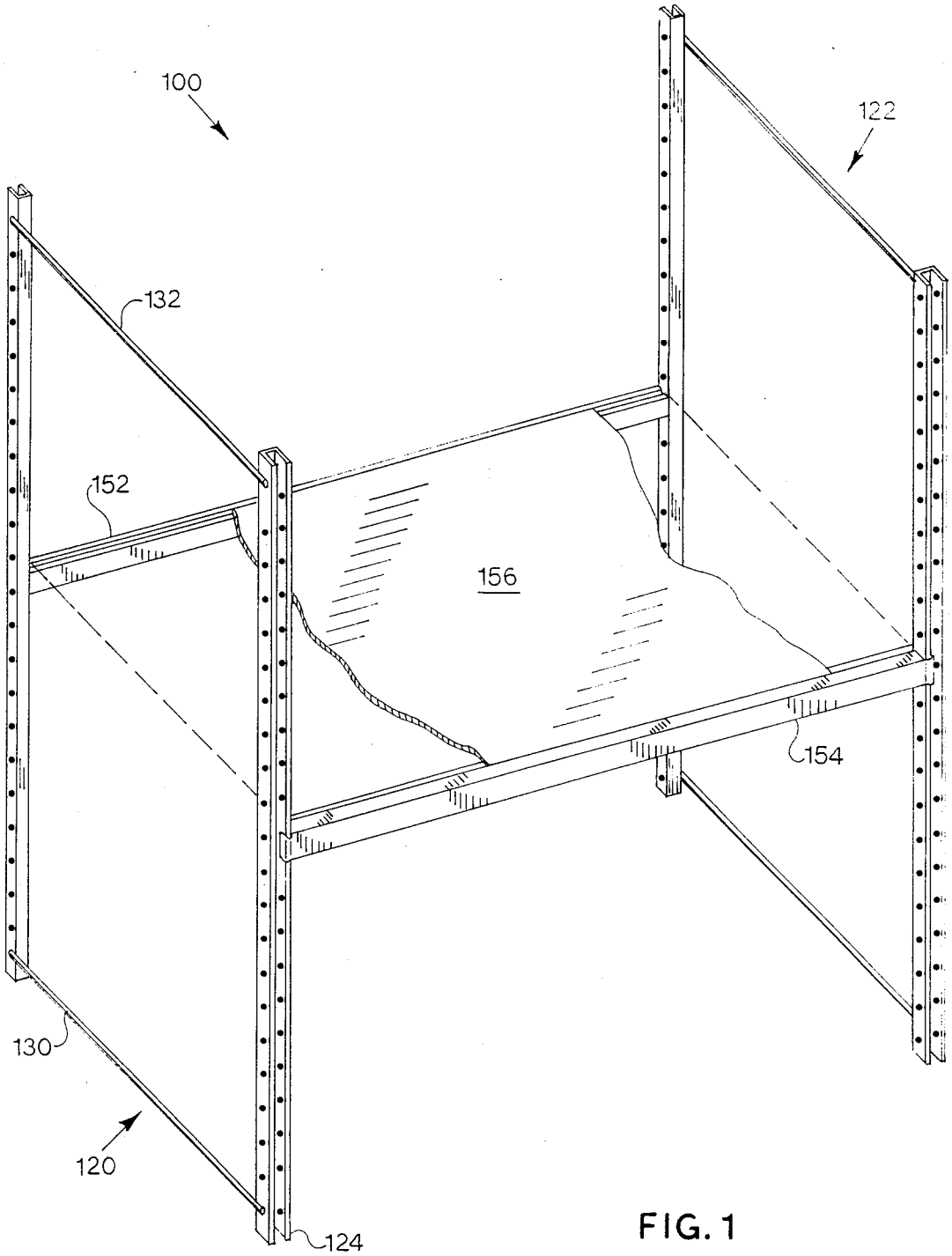
FIG. 1 depicts a perspective view of the heavy-duty, wide-span, adjustable shelf device 100 of this invention.

Referring now to FIG. 1, a perspective view of heavy-duty, wide-span, adjustable shelf device 100 is shown. The heavy-duty, wide-span, adjustable shelf device 100 includes a first stanchion assembly 120 and a second stanchion assembly 122. First stanchion assembly 120 and second stanchion assembly 122 are substantially symmetrical to each other. A first horizontal beam 152 and a second horizontal beam 154 are each connected to both first stanchion assembly 120 and second stanchion assembly 122. First horizontal beam 152 and second horizontal beam 154 are also substantially symmetrical to each other. First horizontal beam 152 and a second horizontal beam 154 combine to support shelf 156 thereon.

Any desired number of first stanchion assembly 120 or second stanchion assembly 122 may be used with any desired number of first horizontal beam 152 or second horizontal beam 154 to make shelf device 100 as long as desired. First stanchion assembly 120 is completely interchangeable with second stanchion assembly 122. First horizontal beam 152 is completely interchangeable with second horizontal beam 154. In both of these cases a second number is assigned to same part to facilitate description of the relative positions.

Referring now to FIG. 2, an end view of first stanchion assembly 120 is shown. Symmetrical second stanchion assembly 122 is similar thereto and has the same parts therein. First stanchion assembly 120 has a pair of stanchion U-shaped members 124 with an upper tubular cross brace 126 and a lower tubular cross brace 128 connecting the U-shaped members 124 for supporting the stanchion assembly 120. The stanchion assembly 120 further includes a base support 130 and a top support 132 also connecting the U-shaped members 124. Preferably, upper tubular cross brace 126, lower tubular cross brace 128, base support 130 and a top support 132 connect a pair U-shaped members 124 at base 138 of U-shaped member 124 to form either first stanchion assembly 120 or second stanchion assembly 122.

This first stanchion assembly 120 is generally set with second stanchion assembly 122 in a rectangular shape when combined with one or more first horizontal beam 152 and second horizontal beam 154 to form adjustable shelf device 100. The adjustable shelf device 100 may be placed inside a refrigerator or other food storage area. This shelf device 100 may also have wheels mounted thereon to form a movable rack for supporting the desired material.

Upper tubular cross brace 126 and lower tubular cross brace 128 are angled between the pair of U-shaped members 124. Base support 130 and top support 132 are perpendicular to the pair of U-shaped members 124. Any shape is suitable for these cross members, while a square cross-section is the most desirable. Other connecting means are usable, but the described means provide excellent results.

By reference to FIG. 13, it may be clearly seen that upper tubular cross brace 126 has a square cross-section. The other cross brace members may have a similar cross-section.

Referring now to FIG. 3, a flattened, prior to shaping blank version of U-shaped stanchion member 124 is depicted to clearly show the structure. A plurality of beam apertures 134 appear in both sides 136 of U-shaped member 124. Each beam aperture 134 in one of side 136 has a corresponding, co-axial aperture 134 in the other of side 136. Sides 136 are shaped to be perpendicular to base 138 to form U-shaped member 124.

Considering FIG. 1 and FIG. 3 together, in first stanchion assembly 120, the base 138 of each U-shaped member 124 are facing, perpendicular, and parallel to each other. In this fashion, first beam 152 and second beam 154 can lock first stanchion assembly 120 and second stanchion assembly 122 together to hold shelf 136.

Referring now to FIG. 4 and FIG. 5, each end 158 of first beam 152 and the second beam 154 are symmetrical to the other ends 158. Each end of first beam 152 and second beam 154 includes a shot pin 180 shown in pairs to be received by a pair of beam apertures 134 (shown in FIG. 3). The number of shot pin 180 can be adjusted as desired.

Referring now to FIG. 5, to show the locking mechanisms of the spring loaded assembly 160 of shot pin 180 in the stanchion assembly 120, it may be seen that the beam apertures 134 appear in the apertured side 136. These apertured sides 136 are a side of the U-shaped member 124.

Each end of first beam 152 and second beam 154 includes a spring loaded assembly 160. Spring loaded assembly 160 includes the pair of spring loaded shot pins 180 to provide for receipt thereof by beam apertures 134. Shot pins 180 are received by beam apertures 134 to position first beam 152 and second beam 154 on first stanchion assembly 120 and second stanchion assembly 122.

On bar end 158 is a lipped J-shaped member cap 200. Lipped J-shaped member cap 200 receives edge 140 of side 136 of U-shaped member 124 in locking lip 202. Thus, the first support beam 152 and the second support beam 154 are strongly supported within the stanchion assembly 120 by fitting into the beam apertures 134 and lipping the edge 140 of U-shaped member 124. The shot pin 180 and J-shaped lip 202 combine to strongly position the first stanchion assembly 120 and second stanchion assembly 122 in relation to each other. The locking mechanism is thus achieved.

Figure 6:
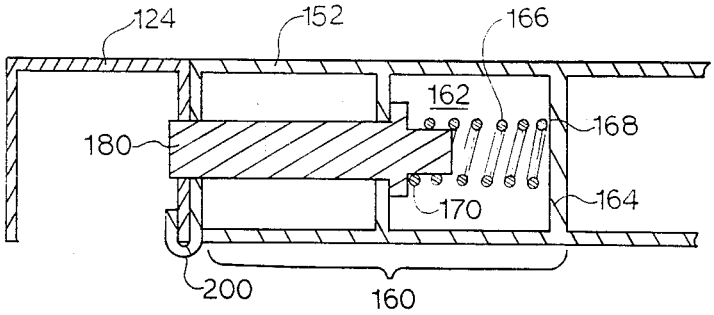
FIG. 6 depicts a top, cut-away, schematic view of spring loaded assembly 160 with shot pin 180 of this invention.
Figure 7:
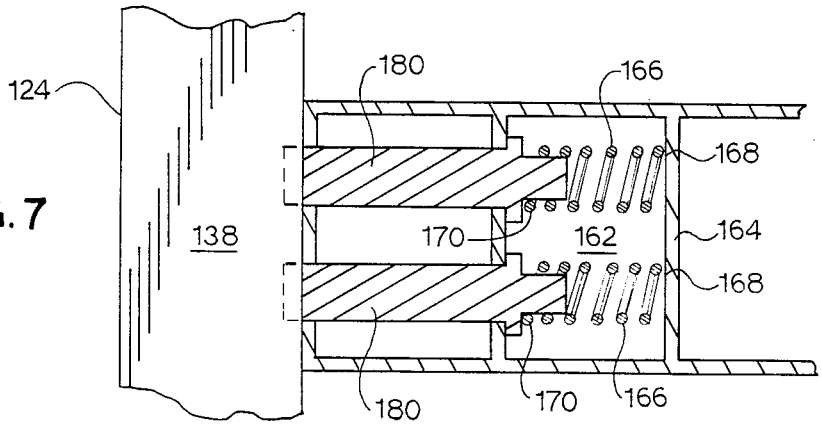
FIG. 7 depicts a rear, cut-away, schematic view of spring loaded assembly, 160 with shot pin 180 of this invention.
Figure 8:
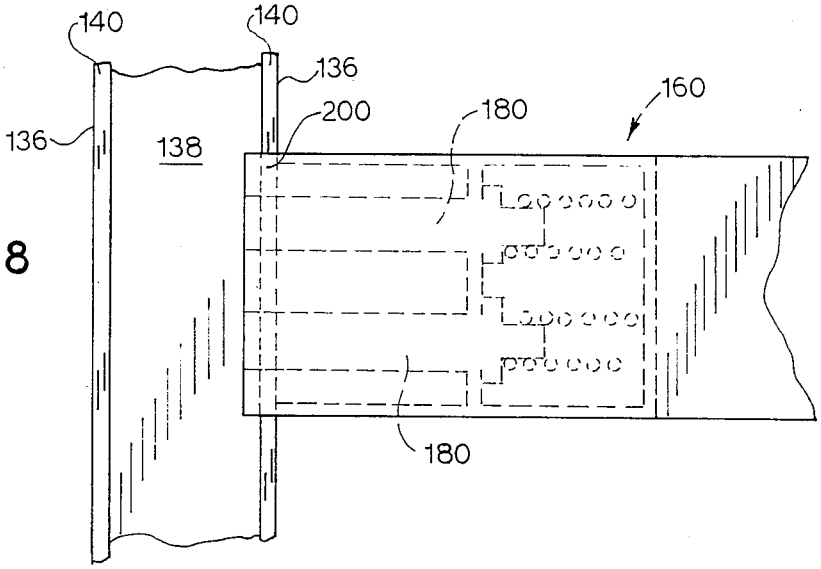
FIG. 8 depicts a front, cut-away, schematic view of spring loaded assembly 160 with shot pin 180 of this invention.

Referring now to FIG. 6, FIG. 7, and FIG. 8, a schematic relationship of the spring loaded assembly 160 is shown. A more clear depiction of spring loaded assembly 160 is shown. Spring loaded assembly 160 includes a chamber 162 in each end 158 of first beam 152 and second beam 154. The chamber 162 has a base 164 for receiving spring 166 at base end 168 of spring 166. Spring 166 also has a tab end 170 oppositely disposed from base end 168. Oppositely disposed from chamber base 164 is lipped J-shaped member 200 serving as a chamber cap which effectively closes the end 158. However, within J-shaped member cap 200 is a cap aperture 174. Cap aperture 174 receives shot pin 180 as a protuberance permitting holding engagement with aperture 134.

Referring now to FIG. 9, FIG. 10, FIG. 11 and FIG. 12, first horizontal beam 152 is depicted. J-shaped member cap 200 is a flat piece having a bend therein to form locking lip 202. Locking lip 202 holds stanchion assembly 120 at edge 140 on the horizontal beam 152. J-shaped member cap 200 has a J-shaped cross section and serves as a chamber cap, which effectively closes the bar end 158.

Horizontal beam 152 is shown as using for a housing basically a hollow tubular member 212 of generally rectangular cross-section. Indented edge 210 extends along one corner of the rectangular solid of hollow tubular member 212 to provide support for shelf 156.

In FIG. 10, springloaded assembly 160 is shown in exploded fashion. Housing 161 for springloaded assembly 160 slides into bar end 158 (shown in FIG. 9). Shot pin 180 includes a shot pin base 182 and a shot pin top 184 separated by a collar 186 secured to shot pin 180. Thus shot pin base 182 and shot pin top 184 may be formed from one piece of metal and defined by collar 186. Shot pin base 182 and shot pin top 184 may also be formed from more than one piece of metal or by other mechanissms, and defined by collar 186.

Collar 186 is of sufficient diameter to be retained by mounting plate aperture 188 in plate support 190. Plate support 190 is situated between collar 186 and J-shaped member cap 200. Shot pin top 184 is of sufficient size to pass through cap aperture 174 and into one of beam apertures 134 (shown in FIG. 5).

This structure in combination with the locking lip 202 of J-shaped member cap 200 (FIG. 5) achieves the strong support in relation to the bracing of the stanchion 120. Upon release of shot pins 182 first support beam 152 and second support beam 154 may be easily moved in an upward or downward fashion and relocked in beam apertures 134 to achieve the desired support, adjustability and strength.

Plate support 190 includes support notches 192 which mesh with housing apertures 194 to lock plate support 190 in position in end 158 of first horizontal beam 152 and second horizontal beam 154. Spring 166 surrounds shot pin base 182 thereby strongly positioning the same.

Housing apertures 194 are in side flanges 196 of housing 161. Thus, housing 161 is U-shaped of sufficient size to slide into bar end 158 with flanges 196 forming the sides of the U-shaped housing 161. The base of the U-shaped housing 161 forms chamber base 164.

Cap receiving knobs 198 on the end of flanges 196 receive the lipped J-shaped member 200 at cap slots 204. Standard securing is used to hold cap slots 204 on cap receiving knobs 198.

Parts of the heavy-duty, wide-span, adjustable shelf device 100 of this invention are joined by welding, snapping together or other suitable means. It is clear that device 100 avoids the crevices, in which food may collect. The the heavy-duty, wide-span, adjustable shelf device 100 is also extremely heavy-duty and can support heavy food containers, while maintaining the desired shelf adjustability.

This application—taken as a whole with the specification, claims, abstract, and drawings—provides sufficient information for a person having ordinary skill in the art to practice the invention disclosed and claimed herein. Any measures necessary to practice this invention are well within the skill of a person having ordinary skill in this art after that person has made a careful study of this disclosure.

Because of this disclosure and solely because of this disclosure, modifications of this method and apparatus can become clear to a person having ordinary skill in this particular art. Such modifications are clearly covered by this disclosure.

What is claimed and sought to be protected by Letters Patent of the United States is:

1. An adjustable shelf assembly suitable for supporting a heavy weight of food having at least one first vertical stanchion assembly and at least one second vertical stanchion assembly joined with at least one first horizontal beam and at least one second horizontal beam for supporting at least one shelf, wherein:

a. said first vertical stanchion assembly and said second vertical stanchion assembly are substantially symmetrical;

b. said first horizontal beam and said second horizontal beam are substantially symmetrical;

c. said first horizontal beam is removably secured to said first vertical stanchion assembly at a first end thereof;

d. said first horizontal beam is removably secured to said second vertical stanchion assembly at a second end thereof;

e. said second horizontal beam is removably secured to said first vertical stanchion assembly at a first end thereof;

f. said second horizontal beam is removably secured to said second vertical stanchion assembly at a second end thereof;

g. said first vertical stanchion assembly includes a first generally U-shaped, vertical member on a first side thereof; and a second generally U-shaped, vertical member on a second side thereof;

h. said first generally U-shaped, vertical member is substantially symmetrical to said second generally U-shaped, vertical member on a second side thereof;

i. said adjustable shelf assembly has minimal crevices so as to minimize receiving food residue therein;

j. said first horizontal beam has a spring loaded assembly secured within each end thereof;

k. said spring loaded assembly fits into at least one aperture within said U-shaped, vertical member with a gripping means providing an additional support for holding said spring loaded assembly in position;

l. said first horizontal beam holds said first vertical stanchion assembly and said second vertical stanchion assembly in a position;

m. said second horizontal beam holds said first vertical stanchion assembly and said second vertical stanchion assembly in said position;

n. said first horizontal beam and said second horizontal beam combine to support a shelf;

o. said first stanchion assembly has a base support and a top support connecting said first generally U-shaped, vertical ember and said second generally U-shaped, vertical member;

p. said first vertical member side and said second vertical member have a plurality of pin receiving apertures therein;

q. each of said plurality of pin receiving apertures in said first vertical member side has a corresponding, co-axial aperture in said second vertical member side;

r. each end of said first horizontal beam is substantially symmetrical to the other end of said first horizontal beam and both ends of said second horizontal beam;

s. said spring loaded assembly includes a shot pin assembly secured in said each end;

t. a shot pin of said shot pin assembly fits into one of said pin receiving apertures;

u. a lipped J-shaped member cap is secured at said each end to hold said shot pin assembly securely in said each end; and v. said lipped J-shaped member cap includes a lip capable of gripping an edge of said first generally U-shaped, vertical member at the same time as said shot pin fits into one of said pin receiving apertures.

2. The adjustable shelf assembly of claim 1 wherein:

a. said first horizontal beam has a spring loaded assembly secured within each end thereof;

b. a gripping means is secured to said each end in order to provide additional support for holding said spring loaded assembly in position within said each end;

c. said spring loaded assembly fits into at least one aperture within said U-shaped, vertical member;

d. said first horizontal beam holds said first vertical stanchion assembly and said second vertical stanchion assembly in a position;

e. said second horizontal beam holds said first vertical stanchion assembly and said second vertical stanchion assembly in said position; and f. said first horizontal beam and said second horizontal beam combine to support a shelf.

3. The adjustable shelf assembly of claim 2 wherein:

a. said adjustable shelf assembly includes at least two of said first vertical stanchion assembly and at least one of said second vertical stanchion assembly; and b. said adjustable shelf assembly includes at least two of first horizontal beam and at least two of said second horizontal beam.

4. The adjustable shelf assembly of claim 2 wherein:

a. said first generally U-shaped, vertical member includes a base and a first vertical member side parallel to and oppositely disposed from a second vertical member side;

b. said first vertical member side and said second vertical member side are perpendicular to said base.

5. The adjustable shelf assembly of claim 4 wherein:

a. said first stanchion assembly has an upper tubular cross brace and a lower tubular cross brace connecting said first generally U-shaped, vertical member and said second generally U-shaped, vertical member;

b. said upper tubular cross brace and said lower tubular cross brace are angled between said first generally U-shaped, vertical member and said second generally U-shaped, vertical member; and c. said base support and said top support are substantially perpendicular to said first generally U-shaped, vertical member and said second generally U-shaped, vertical member.

6. The adjustable shelf assembly of claim 5 wherein said upper tubular cross brace and said lower tubular cross brace and said base support and said top support are substantially of a square cross-section.

7. The adjustable shelf assembly of claim 5 wherein:

a. said each end of said first horizontal beam includes a chamber;

b. said chamber has a chamber base for receiving a spring at a base end of said spring;

c. said spring has a tab end oppositely disposed from said base end of said spring;

d. said lipped J-shaped member cap is oppositely disposed from said chamber base so that said lipped J-shaped member cap effectively closes said each end; and e. a J-shaped cap aperture is within J-shaped member cap to receive said shot pin.

8. The adjustable shelf assembly of claim 7 wherein:

a. said lipped J-shaped member cap includes a flat section and a bend section;

b. said locking lip overlaps an edge of said U-shaped member; and c. said lipped J-shaped member cap has a J-shaped cross section and serves as a chamber cap, which effectively closes said bar end.

9. The adjustable shelf assembly of claim 8 wherein:

a. said horizontal beam has a generally rectangular cross-section; and b. said horizontal beam has an indented edge along one corner of said rectangular cross-section of an L-shape to support said shelf.

10. The adjustable shelf assembly of claim 9 wherein:

a. said springloaded assembly includes said shot pin assembly and said lipped J-shaped member cap;

b. said shot pin assembly includes a housing for said springloaded assembly, at least one spring, at least one shot pin, and a plate support;

c. said shot pin includes a shot pin base and a shot pin top separated by a shot pin collar secured to said shot pin;

d. said collar is of sufficient diameter to be retained by a mounting plate aperture in said plate support;

e. said plate support is situated between said collar and said J-shaped member cap; and f. said shot pin top is of sufficient size to pass through said cap aperture and into one of said bar apertures.

11. The adjustable shelf assembly of claim 10 wherein:

a. said shot pin assembly is releasable;

b. said spring surrounds said shot pin base;

c. said plate support includes support notches which mesh with housing apertures in said housing for said spring-loaded assembly to lock said plate support; and d. said housing for said spring-loaded assembly is U-shaped and of sufficient size to slide into said bar end with flanges forming the sides of said thereof and said chamber base formed by the base thereof.

12. The adjustable shelf assembly of claim 11 wherein said shot pin including said shot pin base, said collar and said shot pin top are one piece.

13. The adjustable shelf assembly of claim 12 wherein said at least two cap receiving knobs on the end of said flanges to receive the said lipped J-shaped member cap at a cap slot in said lipped J-shaped member cap at a cap slot, said cap slot receiving one of said at least two cap receiving knobs in a removably secure fashion.

14. An adjustable shelf assembly suitable for supporting a heavy weight of food having at least one first vertical stanchion assembly and a second vertical stanchion assembly joined with at least one first horizontal beam and at least one second horizontal beam for support at least one shelf, wherein:

a. said first vertical stanchion assembly and said second vertical stanchion assembly are substantially symmetrical;
b. said first horizontal beam and said second horizontal beam are substantially symmetrical;
c. said first horizontal beam is removably secured to said first vertical stanchion assembly at a first end thereof;
d. said first horizontal beam is removably secured to said second vertical stanchion assembly at a second end thereof;
e. said second horizontal beam is removably secured to said first vertical stanchion assembly at a first end thereof;
f. said second horizontal beam is removably secured to said second vertical stanchion assembly at a second end thereof;
g. said first vertical stanchion assembly includes a first generally U-shaped, vertical member on a first side thereof; and a second generally U-shaped, vertical member on a second side thereof;
h. said first generally U-shaped, vertical member is substantially symmetrical to said second generally U-shaped, vertical member on a second side thereof;
i. said adjustable shelf assembly has minimal crevices so as to minimize receiving food residue therein;
j. said first horizontal beam has a spring loaded assembly secured within each end thereof;
k. said spring loaded assembly fits into at least one aperture within said U-shaped, vertical member and a gripping means is secured at said each end to provide an additional support for holding said spring loaded assembly within said each end position;
l. said first horizontal beam holds said first vertical stanchion assembly and said second vertical stanchion assembly in a position;
m. said second horizontal beam holds said first vertical stanchion assembly and said second vertical stanchion assembly in said position;
n. said first horizontal beam and said second horizontal beam combine to support a shelf;
o. said gripping means is a lipped J-shaped member cap;
p. said adjustable shelf assembly includes at least two of said first vertical stanchion assembly and at least one of said second vertical stanchion assembly;
q. said adjustable shelf assembly includes at least two of first horizontal beam and at least two of said second horizontal beam;
r. said first generally U-shaped, vertical member includes a base and a first vertical member side parallel to and oppositely disposed from a second vertical member side;
s. said first vertical member side and said second vertical member side are perpendicular to said base;
t. said first stanchion assembly has an upper tubular cross brace and a lower tubular cross brace connecting said first generally U-shaped, vertical member and said second generally U-shaped, vertical member;
u. said first stanchion assembly has a base support and a top support connecting said first generally U-shaped, vertical member and said second generally U-shaped, vertical member;
v. said upper tubular cross brace and said lower tubular cross brace are angled between said first generally U-shaped, vertical member and said second generally U-shaped, vertical member; and
w. said base support and said top support are substantially perpendicular to said first generally U-shaped, vertical member and said second generally U-shaped, vertical member.

15. The adjustable shelf assembly of claim 14 wherein:

a. said upper tubular cross brace and said lower tubular cross brace and said base support and said top support are substantially of a square cross-section;
b. said first vertical member side and said second vertical member have a plurality of pin receiving apertures therein;
c. said first vertical member side and said second vertical member have a plurality of pin receiving apertures therein;
d. each of said plurality of pin receiving apertures in said first vertical member side has a corresponding, co-axial aperture in said second vertical member side;
e. each end of said first horizontal beam is substantially symmtetrical to the other end of said first horizontal beam and both ends of said second horizontal beam;
f. said spring loaded assembly includes a shot pin assembly secured in said each end;
g a shot pin of said shot pin assembly fits into one of said pin receiving apertures;
h. a lipped J-shaped member cap holds said shot pin assembly is secured in said each end;
i. said lipped J-shaped member cap includes a lip capable of gripping an edge of said first generally U-shaped, vertical member at the same time as said shot pin fits into one of said pin receiving apertures;
j. said each end of said first horizontal beam includes a chamber;
k. said chamber has a chamber base for receiving a spring at a base end of said spring;
l. said spring has a tab end oppositely disposed from said base end;
m. said lipped J-shaped member cap is oppositely disposed from said chamber base so that said lipped J-shaped member cap effectively closes said each end; and
n. a J-shaped cap aperture is within J-shaped member cap to receive said shot pin.

16. The adjustable shelf assembly of claim 15 wherein:

a. said lipped J-shaped member cap includes a flat section and a bend section;

b. said locking lip overlaps an edge of said U-shaped member;

c. said lipped J-shaped member cap has a J-shaped cross section and serves as a chamber cap, which effectively closes said bar end;

d. said horizontal beam has a generally rectangular cross-section;

e. said horizontal beam has an indented edge along one corner of said rectangular cross-section of an L-shape to support said shelf;

f. said springloaded assembly includes said shot pin assembly and said lipped J-shaped member cap;

g. said shot pin assembly includes a housing for said springloaded assembly, at least one spring, at least one shot pin, and a plate support;

h. said shot pin includes a shot pin base and a shot pin top separated by a shot pin collar secured to said shot pin;

i. said collar is of sufficient diameter to be retained by a mounting plate aperture in said plate support;

j. said plate support is situated between said collar and said J-shaped member cap;

k. said shot pin top is of sufficient size to pass through said cap aperture and into one of said bar apertures;

l. said shot pin assembly is releasable;

m. said spring surrounds said shot pin base;

n. said plate support includes support notches which mesh with housing apertures in said housing for said spring-loaded assembly to lock said plate support; and o. said housing for said spring-loaded assembly is U-shaped and of sufficient size to slide into said bar end with flanges forming the sides of said thereof and said chamber base formed by the base thereof.

17. The adjustable shelf assembly of claim 16 wherein:

a. said shot pin including said shot pin base, said collar and said shot pin top are one piece; and b. said at least two cap receiving knobs on the end of said flanges to receive the said lipped J-shaped member cap at a cap slot in said lipped J-shaped member cap at a cap slot, said cap slot receiving one of said at least two cap receiving knobs in a removably secure fashion.

* * * * *